United States Patent [19]

Allaire et al.

[11] 4,330,503

[45] May 18, 1982

[54] WOOD BURNING STOVE

[75] Inventors: Roger A. Allaire, Big Flats; William F. Pardue, Jr.; Robert V. VanDewoestine, both of Corning, all of N.Y.

[73] Assignee: Corning Glass Works, Corning, N.Y.

[21] Appl. No.: 173,157

[22] Filed: Jul. 28, 1980

[51] Int. Cl.[3] ..... F01N 3/15

[52] U.S. Cl. ..... 422/177; 110/203; 110/214; 126/163 R; 126/285 R; 126/289; 422/200

[58] Field of Search ..... 422/177, 200, 174; 126/92 R, 163 R, 164, 285 R, 289, 287; 110/163, 203, 210, 214, 190

[56] References Cited

U.S. PATENT DOCUMENTS

| | | | |
|---|---|---|---|
| 2,273,418 | 2/1942 | Prince | 126/285 R X |
| 2,362,972 | 11/1944 | Brownback | 126/92 R X |
| 2,443,910 | 6/1948 | Higley | 126/287 X |
| 2,845,882 | 8/1958 | Bratton | 110/190 X |
| 3,090,677 | 5/1963 | Scheitlin et al. | 422/174 |
| 3,213,846 | 10/1965 | Rogers, Jr. et al. | 126/164 X |
| 3,486,841 | 12/1969 | Betz | 422/177 X |
| 3,610,179 | 10/1971 | Shaw, Jr. et al. | 110/214 |
| 3,611,954 | 10/1971 | Monroe, Jr. | 110/210 X |
| 3,749,130 | 7/1973 | Howitt et al. | 422/177 X |
| 3,805,763 | 4/1974 | Cowan | 126/92 R |
| 3,961,478 | 6/1976 | Lange | 422/177 X |
| 4,054,418 | 10/1977 | Miller et al. | 110/203 X |

*Primary Examiner*—Richard L. Chiesa
*Attorney, Agent, or Firm*—Richard N. Wardell

[57] ABSTRACT

Disclosed herein is an improved wood burning stove employing a combustion chamber and a flue for removing exhaust therefrom and also a catalytic converter means for oxidizing oxidizable species in the exhaust. A passageway is provided for bypassing the exhaust around the catalytic converter means, the passageway being controlled by a bypass damper for controlling access to the passageway for varying impedance otherwise presented to the exhaust by the converter, for example, during the addition of fuel to the stove. Such an arrangement minimizes back pressure caused by the converter means.

8 Claims, 2 Drawing Figures

WOOD BURNING STOVE

BACKGROUND OF THE INVENTION

This invention relates in general to an improvement in wood burning stoves and in particular it relates to a method and apparatus for increasing the efficiency and safety of wood burning stoves.

Due to the relative scarcity and high cost of petroleum products, wood burning stoves have been increasingly employed for home heating and other purposes. A reasonably air tight wood burning stove is far more efficient than a home fireplace, which may result, in fact, in a net energy loss. However, wood burning stoves presently being utilized suffer from three significant drawbacks. First, wood burning stoves represent a severe fire hazard since the wood fuel therefore contains volatible substances which are normally not oxidized during combustion. These volatiles will burn if mixed with air at temperatures in excess of 590° C. However, the typical wood burning stove operates within a temperature range of between 230° and 370° C. At these temperatures, these volatible substances, known generally as creosote, remain unoxidized and tend to adhere to the flue pipes and are a cause of not infrequent chimney fires. Secondly, the incomplete combustion of the carbonaceous fuel in wood burning stoves leaves the unoxidized residue as a pollutant and an environmental hazard which is discharged to the atmosphere. Third, the unoxidized residue represents a loss of overall combustion efficiency. While claims have been made to efficiencies greater than 65% in some wood burning stoves, independent testing laboratories have determined that the combustion efficiency of typical wood burning stoves lies in the range of between 50 and 65%. One possible solution to the aforementioned problems is to increase the combustion temperature of the typical wood burning stove by providing additional air into the combustion chamber so as to create temperatures high enough to bring about complete combustion. Variations on this technique date back to the 18th century with the Franklin stove, wherein the volatiles are mixed with additional air in the combustion chamber in order that temperatures high enough to bring about complete combustion may be obtained. These efforts have only been partially successful.

In application Ser. No. 173,155, filed July 28, 1980, by Van Dewoestine which is assigned to the assignee of the present invention, an improved wood burning stove is disclosed which obviates the foregoing problems. The wood burning stove disclosed therein employs a catalytic converter means which oxidizes oxidizable species in the exhaust from a standard wood burning stove. A wood burning stove modified to include a catalytic converter means provides increased safety due to the removal of creosote from the exhaust therefrom. Secondly, the wood burning stove disclosed by Van Dewoestine reduces unoxidized carbonaceous pollutants emitted from the stove. Thirdly, the improved wood burning stove disclosed by Van Dewoestine provides improved fuel efficiency through the use of the catalytic converter means.

However, it has been found that during startup and also once combustion is started and during the addition of fuel to the wood burning stove disclosed by Van Dewoestine, the impedance to the exhaust emanating from the stove caused by the catalytic converter means is detrimental. Specifically, it has been found that when the stove is opened, such as for example, when adding additional fuel, back pressure caused by the catalytic converter becomes excessive such that smoke and soot may emanate from the opening to the stove and may be expelled into the room being heated.

One prior arrangement for overcoming this problem is the bypass damper means for selectively closing the bypass as disclosed in the copending application Ser. No. 136,687, filed Apr. 2, 1980, by Albertsen, which is assigned to the assignee of the present invention.

OBJECTS OF THE INVENTION

It is an object of the present invention to provide an improved wood burning stove employing a catalytic converter means which eliminates excessive back pressure during the loading of additional fuel to the stove.

It is a further object of the present invention to provide an improved wood burning stove employing a catalytic converter means which minimizes back pressure during start up of combustion in the stove.

SUMMARY OF THE INVENTION

These and other objects of the present invention are achieved by the provision of a wood burning stove having a combustion chamber and a flue for removing an exhaust from the chamber and a catalytic converter means for oxidizing oxidizable species in the exhaust. However, a passageway is provided for bypassing the exhaust around the catalytic converter means, a bypass damper being situated with respect to the passageway such that access thereto may be controlled during the addition of new or additional fuel to a wood burning stove. In this manner, impedance otherwise presented to the exhaust by the converter means may be selectively varied.

In one embodiment of the present invention, a flue communicates with the combustion chamber at an exit port therefrom and the catalytic converter means is at least partially situated within the combustion chamber at the exit port. In this embodiment, the bypass passageway communicates with the combustion chamber and also with the flue.

In another embodiment of the present invention, a heat exchange chamber is provided intermediately between the combustion chamber and the flue. A catalytic converter means is situated in an opening between the combustion chamber and the heat exchange chamber. A bypass passageway is provided which communicates between the combustion chamber and the flue. In each embodiment, a bypass damper is provided for selectively varying the impedance otherwise presented by the catalytic converter means.

RELATED APPLICATION

The copending application Ser. No. 173,156, filed July 28, 1980, of Van Dewoestine and Allaire which is assigned to the assignee of the present invention, discloses an alternative mounting means for a catalytic converter in a wood burning stove which minimizes back pressure and plugging during loading and start up.

DESCRIPTION OF THE PREFERRED EMBODIMENT

Figure 1:
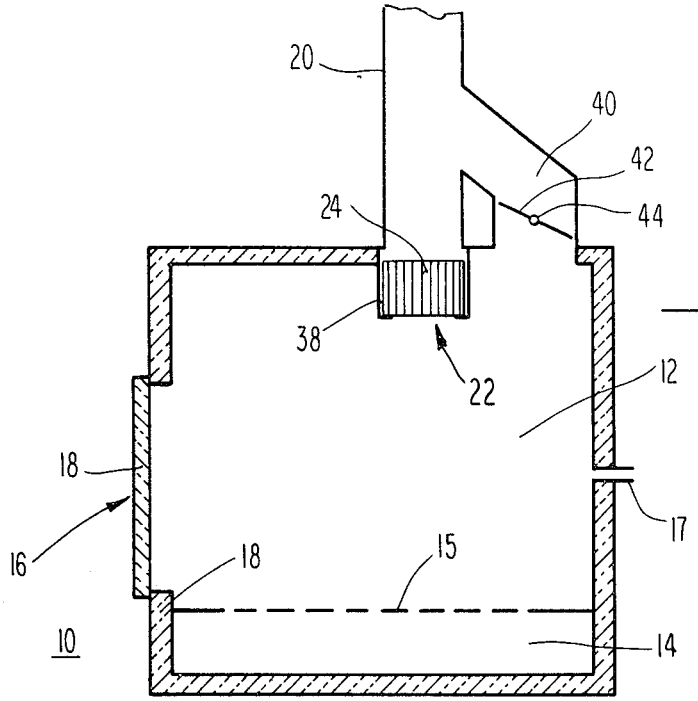
FIG. 1 is a cross-sectional view of a wood burning stove employing a catalytic converter means mounted in accordance with one embodiment of the present invention.

Referring now to FIG. 1, a cross-sectional view of a typical wood burning stove modified in accordance with one embodiment of the present invention will be described. A wood burning stove is shown generally at 10. The wood burning stove 10 includes a fire box or primary combustion chamber 12 situated above an ash pan 14. Communication between the combustion chamber 12 and the ash pan 14 is accomplished by means of a grate 15. Access to the primary combustion chamber 12 is by means of an entrance door or hatch shown generally at 16. Suitable insulation 18 may surround the combustion chamber 12 including the interior surface of the hatch or door 16, although such insulation is not a requirement. A flue 20 communicates with the combustion chamber 12 by means of an exit port 22. A primary air inlet 17 provides a source of oxygen for combustion within the primary combustion chamber 12. Wood fuel is combusted in the primary combustion chamber 12 and exhaust gases emanating therefrom pass through the exit port 22 to the flue 20 and from there to the outside environment. In accordance with the invention described in the aforementioned application of Van Dewoestine, Ser. No. 173,155, a catalytic converter means 24 is situated adjacent the exit port 22 in communication with the flue 20. As may be seen from FIG. 1, the catalytic converter means 24 is retained in a mounting bracket 38 therefor.

In accordance with the present invention, a passageway 40, spaced apart from catalytic converter means 24, is provided for permitting the exhaust emanating from the combustion chamber 12 to bypass the catalytic converter means 24. Access to the bypass passageway 40 is controlled by means of a bypass damper 42 which is rotatable about an axis 44. A suitable handle (not shown) projects from the bypass passageway at the axis 44 for controlling the angular position of the bypass damper 42 within the bypass passageway 40. In this manner, the impedance presented to exhaust gases exiting the combustion chamber to the flue 20 may be selectively varied.

During the initial start up of combustion in the stove 10, and also during the period when the door or hatch 16 is open for the insertion of additional wood fuel into the primary combustion chamber 12, the damper 42 is opened so as to minimize the impedance. In this manner, back pressure caused by the presence of the catalytic converter with attendant smoke and said problem may be minimized. The aforementioned insulation 18 is provided to ensure that at least some of the heat liberated in the combustion chamber 12 is utilized to cause light off of the converter means 24.

Figure 2:
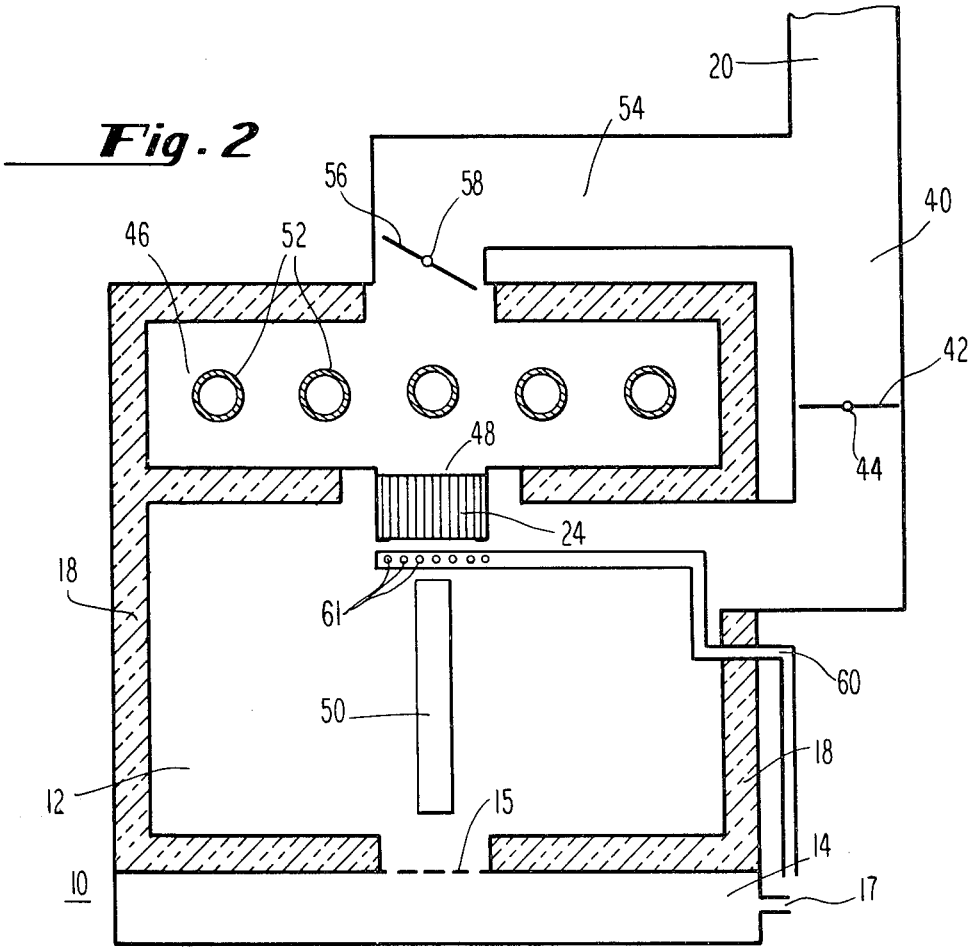
FIG. 2 is a cross-sectional view of a wood burning stove employing a catalytic converter means mounted in accordance with the second embodiment of the present invention.

Referring now to FIG. 2, another embodiment of the present invention will be seen with like numerals referring to items common to those shown in the embodiment of FIG. 1. FIG. 2 discloses a wood burning stove 10 having a primary combustion chamber 12 wherein wood fuel is combusted. Wood fuel is placed in the primary combustion chamber 12 by means of a door or hatch (not shown). Communication between the primary combustion chamber 12 and the ash pan 14 is by way of the grate 15 as shown. Oxygen for combustion enters the primary combustion chamber 12 by means of a primary air inlet 17 and from the primary air inlet 17 through the grate 15. The primary combustion chamber 12 is also insulated to ensure that some heat liberated in the combustion chamber 12 is utilized to cause light off of the converter means 24. Unlike the embodiment shown in FIG. 1, in addition to the provision of a primary combustion chamber 12, the embodiment shown in FIG. 2 also includes a heat exchange chamber 46 interconnected by means of an opening 48 to the primary combustion chamber 12. Situated in or adjacent to the opening 48 is a catalytic converter means 24.

Combustion gases from the combustion chamber 12 are directed by means of a flow director or vane 50 to the catalytic converter means 48 and catalyzed combustion gases are then passed through the heat exchange chamber 46 in the vicinity of the heat exchanger comprising a serpentine series of pipes or tubes 52. The combustion gases are then directed to the flue 20 by means of a communicating passageway 54. Entrance to the communicating passageway 54 as controlled by means of a damper 56 which is rotatable about an axis 58. In accordance with this embodiment of the present invention, a bypass passageway 40 communicating with the primary combustion chamber 12 and the flue 20 is provided. Access to the bypass passageway 40 is controlled by means of a bypass damper 42 rotatable about an axis 44. Opening of the bypass damper 42 and closing of damper 56 permits exhaust gases to bypass the catalytic converter means 24 as well as the heat exchange chamber 46 such that the impedance presented thereby may be diminished during periods of combustion start up and when additional wood fuel is added to the combustion chamber 12.

In the embodiment shown in FIG. 2, a secondary air inlet 60 is preferably provided such that additional oxygen may be provided to the vicinity of the catalytic converter means 24 for sufficient operation thereof. The secondary air inlet 60 preferably comprises a tube one end of which contains apertures 61 adjacent the converter means 24, the other end end terminating in the vicinity of the primary air inlet 17.

While particular embodiments of the present invention have been shown and described, other modifications of the invention not specifically mentioned above will occur to those skilled in the art. For example, when the catalytic converter means 24 is mounted within the flue 20, a bypass passageway may be provided which communicates upstream and downstream of the catalytic converter means rather than communicating directly with the primary combustion chamber 12. Accordingly, this and other embodiments are intended to be included within the scope of the appended claims.

What is claimed is:

1. A wood burning stove comprising:

a combustion chamber including a grate, a side access door and combustion air inlet means;

a flue for removing combustion exhaust from said chamber;

a catalytic converter means for oxidizing oxidizable species in said exhaust;

a passageway spaced apart from said catalytic converter means for bypassing said exhaust around said catalytic converter means; and a bypass damper for controlling exhaust access to said passageway whereby the impedance otherwise presented to said exhaust by said converter means in exiting the combustion chamber to the flue may be selectively varied.

2. The wood burning stove of claim 1 wherein said flue communicates with said combustion chamber at an exit port and wherein said catalytic converter means is at least partially situated in said chamber at said exit port.

3. The wood burning stove of claim 2 wherein said passageway communicates with said combustion chamber and with said flue.

4. The wood burning stove of claim 1 further comprising:

a heat exchange chamber in communication with said flue; and an opening interconnecting said combustion and heat exchange chambers, said catalytic converter means being situated in or adjacent said opening.

5. The wood burning stove of claim 4 wherein said passageway communicates with said combustion chamber and with said flue.

6. The wood burning stove of claim 1 wherein said catalytic converter means is situated in said flue and wherein said passageway communicates with said flue upstream and downstream of said converter means.

7. The wood burning stove of claim 1 including exhaust flow director means in said combustion chamber for directing said combustion exhaust to the catalytic converter means, said exhaust flow director means comprising a vane extending perpendicularly towards a central portion of an inlet face of said catalytic converter means from a point above and near said grate.

8. The wood burning stove of claim 1 or 7 including a primary air inlet to the lower part of the combustion chamber beneath the grate therein and a secondary air inlet adjacent the inlet face of the converter means receiving exhaust from the combustion chamber.

* * * * *

REEXAMINATION CERTIFICATE (439th)

United States Patent [19] [11] B1 4,330,503

Allaire et al. [45] Certificate Issued Dec. 17, 1985

[54] WOOD BURNING STOVE

[75] Inventors: Roger A. Allaire, Big Flats; William F. Pardue, Jr.; Robert V. VanDewoestine, both of Corning, all of N.Y.

[73] Assignee: Corning Glass Works, Corning, N.Y.

Reexamination Request:
No. 90/000,509, Feb. 27, 1984

Reexamination Certificate for:

| | |
|---|---|
| Patent No.: | **4,330,503** |
| Issued: | **May 18, 1982** |
| Appl. No.: | **173,157** |
| Filed: | **Jul. 28, 1980** |

[51] Int. Cl.[4] ..... F01N 3/10

[52] U.S. Cl. ..... 422/177; 110/203; 110/214; 126/163 R; 126/285 R; 126/289; 422/176; 422/200

[58] Field of Search ..... 165/39; 55/307, DIG. 30; 110/210, 214; 422/177, 200, 176

[56] References Cited

U.S. PATENT DOCUMENTS

| | | | |
|---|---|---|---|
| 2,845,882 | 8/1958 | Bratton | 110/190 X |
| 3,043,245 | 2/1955 | Hebert et al. | 110/210 |
| 3,486,841 | 12/1969 | Betz | 422/177 X |
| 4,054,418 | 10/1977 | Miller et al. | 110/203 X |
| 4,103,735 | 8/1978 | Warner | 165/39 |
| 4,279,629 | 7/1981 | Simms | 55/307 |

*Primary Examiner*—Richard L. Chiesa

[57] ABSTRACT

Disclosed herein is an improved wood burning stove employing a combustion chamber and a flue for removing exhaust therefrom and also a catalytic converter means for oxidizing oxidizable species in the exhaust. A passageway is provided for bypassing the exhaust around the catalytic converter means, the passageway being controlled by a bypass damper for controlling access to the passageway for varying impedance otherwise presented to the exhaust by the converter, for example, during the addition of fuel to the stove. Such an arrangement minimizes back pressure caused by the converter means.

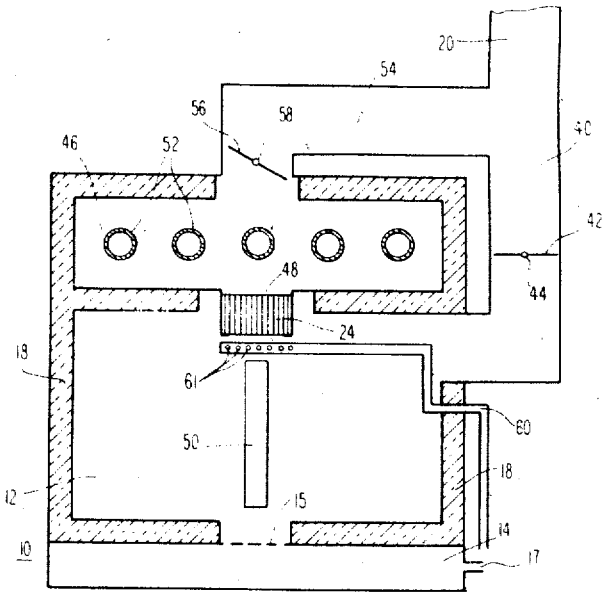

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 7 is confirmed.

Claims 1–6 are cancelled.

Claim 8 is determined to be patentable as amended.

8. The wood burning stove of claim [1 or] 7 including a primary air inlet to the lower part of the combustion chamber beneath the grate therein and a secondary air inlet adjacent the inlet face of the converter means receiving exhaust from the combustion chamber.

* * * * *